US007090589B2

(12) United States Patent
Andersen

(10) Patent No.: US 7,090,589 B2
(45) Date of Patent: Aug. 15, 2006

(54) GOLF SWING TRAINER

(76) Inventor: Thomas A. Andersen, 1520 Highland Ave., Duarte, CA (US) 91010

( * ) Notice: Subject to any disclaimer, the term of this patent is extended or adjusted under 35 U.S.C. 154(b) by 0 days.

(21) Appl. No.: 10/850,079

(22) Filed: May 19, 2004

(65) Prior Publication Data

US 2005/0261074 A1 Nov. 24, 2005

(51) Int. Cl.

| | |
|---|---|
| ***A63B 69/36*** | (2006.01) |
| ***A63B 53/10*** | (2006.01) |
| ***A63B 53/12*** | (2006.01) |

(52) U.S. Cl. ..... 473/256; 473/297; 473/316; 473/318

(58) Field of Classification Search ..... 473/256, 473/297, 326, 334–339, 316–318, 333, 346, 473/349

See application file for complete search history.

(56) References Cited

U.S. PATENT DOCUMENTS

| | | | | |
|---|---|---|---|---|
| 3,075,768 | A * | 1/1963 | Karns | 473/297 |
| 3,606,327 | A * | 9/1971 | Gorman | 473/297 |
| 3,845,960 | A * | 11/1974 | Thompson | 473/336 |
| 4,145,052 | A * | 3/1979 | Janssen et al. | 473/338 |
| 4,541,631 | A * | 9/1985 | Sasse | 473/297 |
| 4,715,606 | A * | 12/1987 | Varley | 473/256 |
| 5,082,279 | A * | 1/1992 | Hull et al. | 473/242 |
| 5,316,300 | A * | 5/1994 | Simmons | 473/318 |
| 5,582,407 | A | 12/1996 | Sorenson | |
| 5,766,090 | A * | 6/1998 | Orlowski | 473/316 |
| 5,803,829 | A * | 9/1998 | Hayashi | 473/326 |
| 6,500,074 | B1 * | 12/2002 | Thacker | 473/234 |
| 6,641,490 | B1 * | 11/2003 | Ellemor | 473/326 |

* cited by examiner

*Primary Examiner*—Sebastiano Passaniti
(74) *Attorney, Agent, or Firm*—The Soni Law Firm; Stephen T. Bang

(57) ABSTRACT

A golf swing trainer comprises a shaft having a grip end and a head end, and a weighted filling inside the shaft. The weighted filling comprises lead shot, tungsten powder, and polyurethane resin to give the trainer the feel of a regular golf club.

19 Claims, 1 Drawing Sheet

GOLF SWING TRAINER

BACKGROUND

The present invention relates to golf swing practice equipment.

There are many golf swing trainers in the marketplace which claim to help golfers have a correct swing on a consistent basis. Exemplary of such golf swing trainers is that described in Sorenson U.S. Pat. No. 5,582,407.

Also, more than one year ago I invented and sold the golf swing trainer described in U.S. Provisional Application Ser. No. 60/384,502 filed May 29, 2002.

Existing golf swing trainers suffer from one or more disadvantages, including:

- Inability to actually hit a golf ball with the trainer to provide feedback to the golfer as to the effectiveness of the golfer's swing.
- Failure to meet USGA compliant requirements for on course use.
- Lack of the "feel" of an actual golf club.

The present invention is directed to a golf swing trainer that overcomes deficiencies of prior golf swing trainers.

SUMMARY

A golf swing trainer according to the present invention comprises a shaft having a grip end and a head end, and a weighted filling inside the shaft. The weighted filling comprises a first size of high density particles with interstices between them and tungsten powder in a lower section, and a second type of high density particles in an upper section, the lower section being closer to the head end and is the upper section. The high density particles typically have a density of at least 8 g/cc and are spheroidal; preferably they are lead shot. The two types of particles can be of the same material or different materials, and can have the same size or different size. So the trainer can be used as a regular golf club, it can have a grip on the grip end of the shaft and a club head on the head end of the shaft.

So that the trainer has the feel of a regular golf club during the swing, the filling material can include urethane resin. In one version of the invention there is cured urethane resin only in the upper section. So that the urethane resin is only in the upper section, there is a liquid impermeable barrier between the two sections.

In one version of the invention, the tungsten powder can move during the swing, to help the user swing properly. This can be effected by having the tungsten powder be present in only a portion of the lower section.

For a club that is useable on the golf course, according to the United States Golf Association ("USGA") it is not permissible to have any moving parts. In an alternate version of the invention satisfying USGA requirements, there is no barrier and there is cured polymeric material, such as urethane resin, along the length of the shaft, wherever there are particles to prevent the particles from moving during a swing.

DRAWINGS

These and other features of the invention could be better understood with reference to the following description, appended claims, and accompanying drawings where:

The drawings are not to scale.

DESCRIPTION

Figure 1:
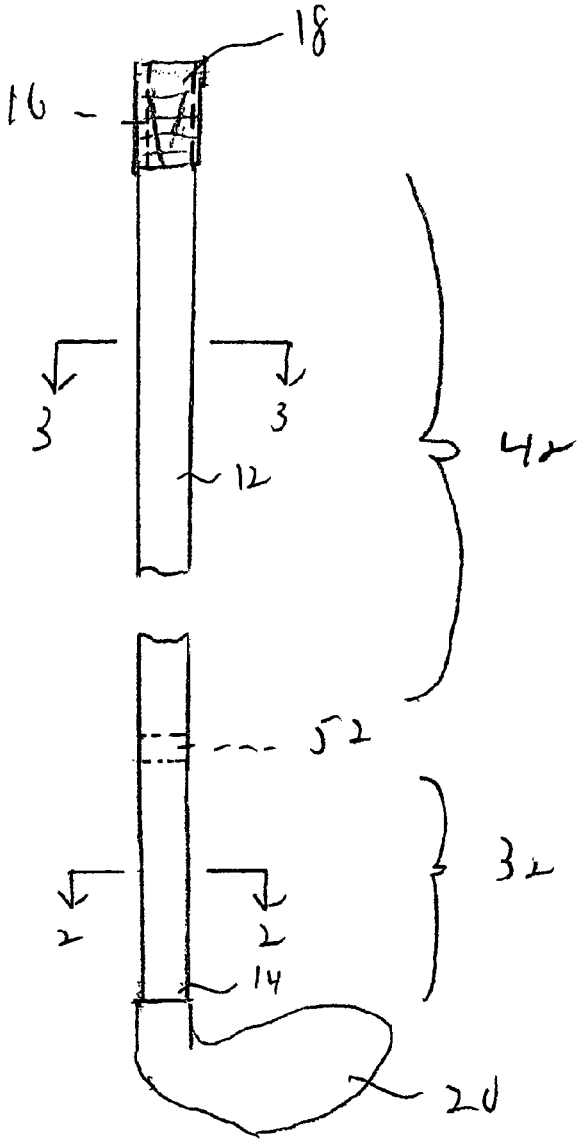
FIG. 1 is a front elevation view of swing trainer embodying features of the present invention.
Figure 3:
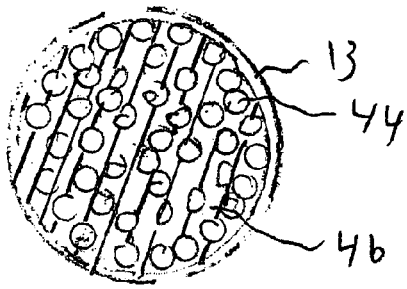
FIG. 3 is a transverse, partial sectional view of the swing trainer of FIG. 1 taken on line 3—3 in FIG. 1.
Figure 2:
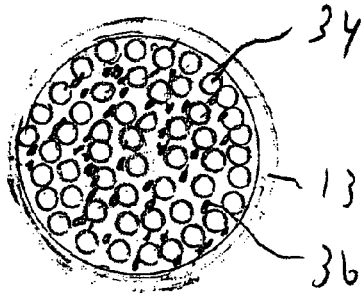
FIG. 2 is a transverse, partial sectional view of the swing trainer of FIG. 1 taken on line 2—2 in FIG. 1.

With reference to FIGS. 1–3, a swing trainer 10 according to the present invention comprises a shaft 12 having a wall 13, a head end 14 and a grip end 16, with a grip 18 mounted on the grip end 16 and a golf club head 20 mounted on the head end 14.

The shaft is hollow substantially along its entire length. For the reasons detailed below, the grip end 16 needs to be hollow. The bottom portion of the lower end need not be hollow.

The shaft 12 can be made of any material conventionally used for golf clubs, such as a steel, graphite or tungsten alloy. The shaft 12 can be a substantially constant diameter, but preferably is tapered, with a larger diameter at the grip end 16 then at the head end 14. For example, the outside diameter of the grip end 16 can be about 9/16 inch, and the outside diameter of the head end 14 can be about 5/16 inch.

The golf club head 20 can be any head conventionally used on golf clubs. It can be an iron, a wedge, or a driver. It typically is not a putter head.

The grip 18 can be any conventional golf club grip. Optionally, it can be a training grip which is configured to require the golfer place his or her hands in a proper position for an effective golf swing.

There is a weighted filling inside of the shaft 12. In a lower section 32 of the shaft 12 the filling can comprise a first size of lead shot 34 and tungsten powder 36.

In an upper section 42 of the shaft 12, the filling can comprise a second size of lead shot 44 and cured epoxy resin 46. The lower section 32 is closer to the head end 14 than is the upper section 42. The size of the lead shot 34 and 44 can be the same, but preferably the first size 34 is of larger diameter than the second size 44 to accommodate the tungsten powder 36 in interstices.

The length of the lower section 32 can be about 8 to about 16 inches, and preferably is about 12 to about 14 inches.

Typically, the lower section 32 has size 5 shot which has an average diameter of 0.12 inches. Preferably, the lead shot used in the upper section 42 is a size 8 or 10 lead shot, which has an average outside diameter of 0.09 inch and 0.07 inch, respectively. More than one size of lead shot can be used in either or both sections.

A preferred tungsten powder has a tab density of at least 9 g/cc. A preferred powder is available from Tungsten Heavy Powder, Inc. of San Diego, Calif. under the name "Technon® Ultra Powder. This spheroidal powder comprises 98%–99% tungsten, with a tab density according to ASTM spec 527 of at least 10–11 g/cc; a particle size of 30–100 microns; and a flowability according to ASTM spec B212 of 7.2 seconds. This powder is prepared from sintered tungsten parts with a higher density than virgin tungsten powder. The tungsten powder typically can be size 100 mesh.

The tungsten powder 36 fills a portion of the lower section, typically only about half of it, so that the tungsten powder can move during the golf swing shift position. That is why larger diameter lead shot with more void space is used in the lower section. This helps a golfer perform a proper wrist cock, which adds distance to the golfer's shot.

Also, the lower section need not be completely filled with lead shot 34 so that the lead shot can also move in the lower section during a swing.

There is a barrier or gasket 52 between the lower section 32 and upper section 42. Preferably, the barrier 52 is liquid impervious. It can be made out of cork covered with cloth, vinyl or rubber material. Its purpose is to keep uncured resin from reaching the lower section.

Cured polymeric material, such as SBR rubber, Kraton™ material, or polyurethane resin, can be part of the filling material. Preferably polyurethane resin 46 is cured in situ and provides a high "rebound effect" so that the club has a realistic feel. It can have a Shore A hardness of about 80. A suitable preferred polyurethane is available from Cytec Industries, Inc. of Olean, N.Y. under the product name Conathane® TU-6080. This preferred polyurethane has a viscosity at 25° C. of about 2600 UPS before cure; a tensile strength of about 2025 psi; 100% modulus of about 610; 300% modulus of about 1550, an elongation of about 350%; and a tear strength of about 275 pli.

The weight system is designed so that the balance point of the trainer is not at its center, but is closer to the head end than the grip end. Preferably is from about 2 to about 4 inches closer to the head end than it is to the grip end. This approximates the feel of a regular golf club.

To manufacture the swing trainer 10, lead shot 34 is placed in the lower section 32 and then the tungsten powder 36 is placed in the lower section 32. To keep the lead shot 34 and tungsten powder 36 from falling out of the bottom, a shaft with the enclosed bottom can be used, a plug can be used, or the golf head 20 can be pre-attached. Next, the barrier 52 is pushed into place. A small amount of uncured resin is then added. Then a small amount of lead shot 44 is placed into the upper section 42, displacing the resin, while allowing the lead shot to be surrounded on all sides by the resin. The resin is prepared by mixing components of the polyurethane resin. This process is repeated until the shaft is filled. The uncured resin is allowed to cure in situ. The grip 18 is then placed on the shaft. If the club head 20 has not yet been placed in position, it is secured to the shaft.

Optionally, there is an empty space between the top of the shot filling in the upper section 42 and the top of the shaft 12.

Each section can contain different types and different sizes of high density particles, allowing for a change in the weight position.

In an alternate version of the invention, for a club that can be used on a golf course, it is necessary that the filling material not move during a stroke. In this version of the invention, polyurethane resin is used along the entire length of the shaft wherever there is filling material, and there is no barrier 52 in use. The high rebound polyurethane resin keeps the lead shot and tungsten from moving, cushions the weighting material, and provides a lively flexible shaft. Also, smaller size lead shot is used in the bottom section 32 to help prevent movement of the tungsten powder.

The present invention has significant advantages for a golfer including the following:

- It is actually possible to hit the ball with the club to get instant feedback on a swing.
- The weight system forces the golfer to swing properly on plane.
- The correctly placed weight system places the golf swing on the correct swing plane.
- The shifting weight teaches the golfer a proper wrist cock release.
- The correct weighting, similar to a golfer's other clubs, creates muscle memory for the correct swing path.
- Creating the correct swing plane and allowing the golfer to see the ball flight builds confidence, and ingrains a sub-conscious repeatable swing memory.
- The weighted club provides an excellent warmup before playing a round of golf, just as a baseball hitter warms up with a weighted bat in the on deck circle.
- Because of the urethane system, the club has the feel of a regular golf club when the ball is hit.
- The shifting weight provides extra momentum at the bottom of the swing, providing encouragement of the proper wrist release at the bottom of the swing, which is not available with a solid steel bar.
- The use of different sized shot placed discretely inside the shaft along with the resin provides the ability to adjust the weight and feeling of the club that is not available with a solid steel bar.
- This discrete weighting allows the wrist cock and wrist release to be varied, and to vary the feeling of the club according to the abilities and swing speed of the golfer.

In the version of the invention where all of the filling material is held in place by urethane resin, the club can legally be used on the golf course, thus providing an opportunity for an instant "tune up" for the golfer during a round.

EXAMPLES

Example 1

Preparing Seven Iron

A seven iron was prepared by placing the following materials into a shaft in this order:

- Lead shot, #5—4.5 ounces
- Tungsten powder—2.8 ounces
- Barrier
- Lead shot, #8—14.4 ounces and polyurethane resin, two components mixed, to fill the remaining shaft.

Example 2

Preparing Driver

A driver was prepared by placing the following materials into a shaft in this order:

- Lead shot, #5—4 ounces
- Tungsten powder—2.8 ounces
- Barrier
- Lead shot, #10—30 ounces
- Lead shot, #5—8.4 ounces
- Polyurethane resin, two components mixed, to fill the remaining shaft while placing the lead shot above the barrier.

Example 3

Wedge Legal for Use on a Golf Course

A wedge legal for use on a golf course was prepared by placing the following materials into a shaft, in this order.

- Lead shot, #10—5.5 ounces
- Tungsten powder—3.5 ounces
- Lead shot, #5—5.5 ounces In all examples, polyurethane resin was added slowly during the entire procedure, so that none of the filling material embedded in the resin moves during a swing, and provides a cushion of resin surrounding the lead shot to provide "life" to the club. In the case of the wedge, the resin allows the wedge to be usable on course.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" for "step" clause as specified in 35 U.S.C. § 112.

Although the present invention has been described in considerable detail with reference to the preferred versions thereof, other versions are possible. For example, instead of lead shot, steel shot or other high density material can be used. Therefore, the scope of the appended claims should not be limited to the descriptions of the preferred versions contained therein.

The invention claimed is:

1. A golf swing trainer comprising:

a. A shaft having a grip end and a head end; and b. a weighted filling inside the shaft comprising (i) in a lower section of the shaft, a first type of particles having a density of at least 8 g/cc interstices therebetween and tungsten powder in the interstices, the first type of particles and the powder cooperating to form a material that is flowable throughout the lower section, and (ii) in an upper section of the shaft, a second type of particles having a density of at least 8 g/cc therebetween, the second type of particles being formed to remain static in the upper section, the lower section being closer to the head end than is the upper section.

2. The trainer of claim 1 wherein the two types of particles are lead shot.

3. The swing trainer of claim 2 comprising compressible cured urethane resin the upper and lower sections.

4. The swing trainer of claim 2 whereinthe two types of particles have the same size.

5. The swing trainer of claim 2 wherein the average diameter of the first size of lead shot is larger than the average diameter of the second size of lead shot.

6. The swing trainer of claim 1 comprising a grip on the grip end of the stock and a golf club head on the head end of the stock.

7. The swing trainer of claim 1 comprising compressible cured urethane resin the upper section.

8. The swing trainer of claim 1 comprising compressible cured urethane resin in the upper and lower sections.

9. The swing trainer of claim 1 wherein the lower section is about 10 to about 16 inches long.

10. The swing trainer of claim 1 comprising an empty space between the upper section and the grip end of the shaft.

11. The swing trainer of claim 1 wherein only a portion of the lower section contains tungsten power.

12. The trainer of claim 1 wherein the tungsten powder can move in the shaft during a golf swing.

13. The trainer of claim 1 wherein the second type of particle comprises particles of two different sizes.

14. The swing trainer of claim 1 wherein the head end is sized and configured to accommodate a golf club head selected from the group consisting of a driver, a wedge, and a wood.

15. A weighted golf swing trainer comprising:

a. a shaft having a grip end and a head end;

b. a grip on the grip end of the stock;

c. a golf club head on the head end of the stock;

d. a filling inside the shaft comprising (i) lead shot and compressible cured urethane resin in an upper section of the shaft, and lead shot and tungsten powder in a lower section of the shaft, the lower section being closer to the head end than is the upper section.

16. The trainer of claim 15 comprising a liquid impermeable barrier between the two sections.

17. The swing trainer of claim 15 comprising compressible cured urethane resin in the lower section.

18. The swing trainer of claim 17 wherein the compressible urethane resin has a Shore A hardness of about 80.

19. The swing trainer of claim 15 wherein the golf club head is selected from the group consisting of a driver, a wedge, and a wood.

* * * * *